United States Patent [19]

Knowlton

[11] 4,317,252

[45] Mar. 2, 1982

[54] SWEEPER-SCRUBBER

[75] Inventor: Christopher W. Knowlton, Toledo, Ohio

[73] Assignee: The Scott & Fetzer Company, Lakewood, Ohio

[21] Appl. No.: 168,534

[22] Filed: Jul. 14, 1980

[51] Int. Cl.[3] ..... A47L 11/29

[52] U.S. Cl. ..... 15/320; 15/340; 280/474; 414/918

[58] Field of Search ..... 15/320, 340, 50 R, 50 C, 15/80, 82, 83, 84; 414/919; 280/420, 421, 446 B, 467, 468, 469, 470, 471, 472, 474

[56] References Cited

U.S. PATENT DOCUMENTS

| | | | |
|---|---|---|---|
| 2,768,837 | 10/1956 | Prater | 280/446 B |
| 3,311,390 | 3/1967 | Rendessy | 280/446 B X |
| 3,902,219 | 9/1975 | Jones | 15/340 X |
| 3,942,218 | 3/1976 | Krier et al. | 15/340 |
| 4,041,567 | 8/1977 | Burgoon | 15/320 |

FOREIGN PATENT DOCUMENTS 816196 10/1951 Fed. Rep. of Germany ..... 280/474

OTHER PUBLICATIONS

Tennant Company "550 Scrubber," Minn., Minn. 8-1978.

*Primary Examiner*—Chris K. Moore
*Attorney, Agent, or Firm*—Allen D. Gutchess, Jr.

[57] ABSTRACT

A sweeper-scrubber is provided which has a towable scrubbing unit. The scrubbing unit is substantially self-contained, including scrubbing brushes, a pick-up squeegee, a liquid supply tank, and a recovery tank. The sweeper has an arcuate tow bar with a steerable rear wheel located behind the center of curvature of the tow bar. The scrubbing unit has a hitch which engages the arcuate tow bar and can move longitudinally therealong to achieve a high degree of maneuverability. The scrubbing unit also has a multiple reel assembly for flexible lines which supply hydraulic fluid and electrical power from the sweeper. This assembly takes up slack in the flexible lines.

20 Claims, 11 Drawing Figures

SWEEPER-SCRUBBER

This invention relates to a sweeper-scrubber including a substantially self-contained scrubbing unit.

The sweeper-scrubber in accordance with the invention includes a sweeper which can be used alone to sweep large surfaces. The sweeper-scrubber also has a substantially self-contained scrubbing unit which can be used in combination with the sweeper to provide both a sweeping action and a scrubbing action in one pass. The combination is also less costly than two completely separate machines. The scrubbing unit has a front hitch and a reel assembly which handles flexible hoses and lines supplying fluid and power from the sweeper. The reel assembly includes a plurality of reels around which the hoses and lines are wound with the reels being movable toward and away from one another to take up slack. The scrubbing unit also has its own scrubbing brushes, pick-up squeegee, cleaning liquid supply tank, and a recovery tank.

The sweeper includes an arcuate tow bar at the rear which is engaged by the hitch of the scrubbing unit. The hitch can move anywhere along the length of the arcuate bar to provide highly maneuverable cooperation between the sweeper and the scrubbing unit. The sweeper further includes a steerable rear wheel preferably located behind the center of curvature of the arcuate tow bar to achieve the exceptional maneuverability.

It is, therefore, a principal object of the invention to provide a sweeper-scrubber with the sweeper being usable alone or in combination with a scrubbing unit.

Another object of the invention is to provide a sweeper-scrubber including a scrubbing unit with a hitch, and a sweeper with an arcuate tow bar to which the hitch is connected.

A further object of the invention is to provide a sweeper-scrubber with a highly maneuverable hitch connecting the two.

Yet another object of the invention is to provide a sweeper-scrubber including a scrubbing unit with a multiple reel assembly for hoses and lines.

Many other objects and advantages of the invention will be apparent from the following detailed description of a preferred embodiment thereof, reference being made to the accompanying drawings, in which.

Figure 1:
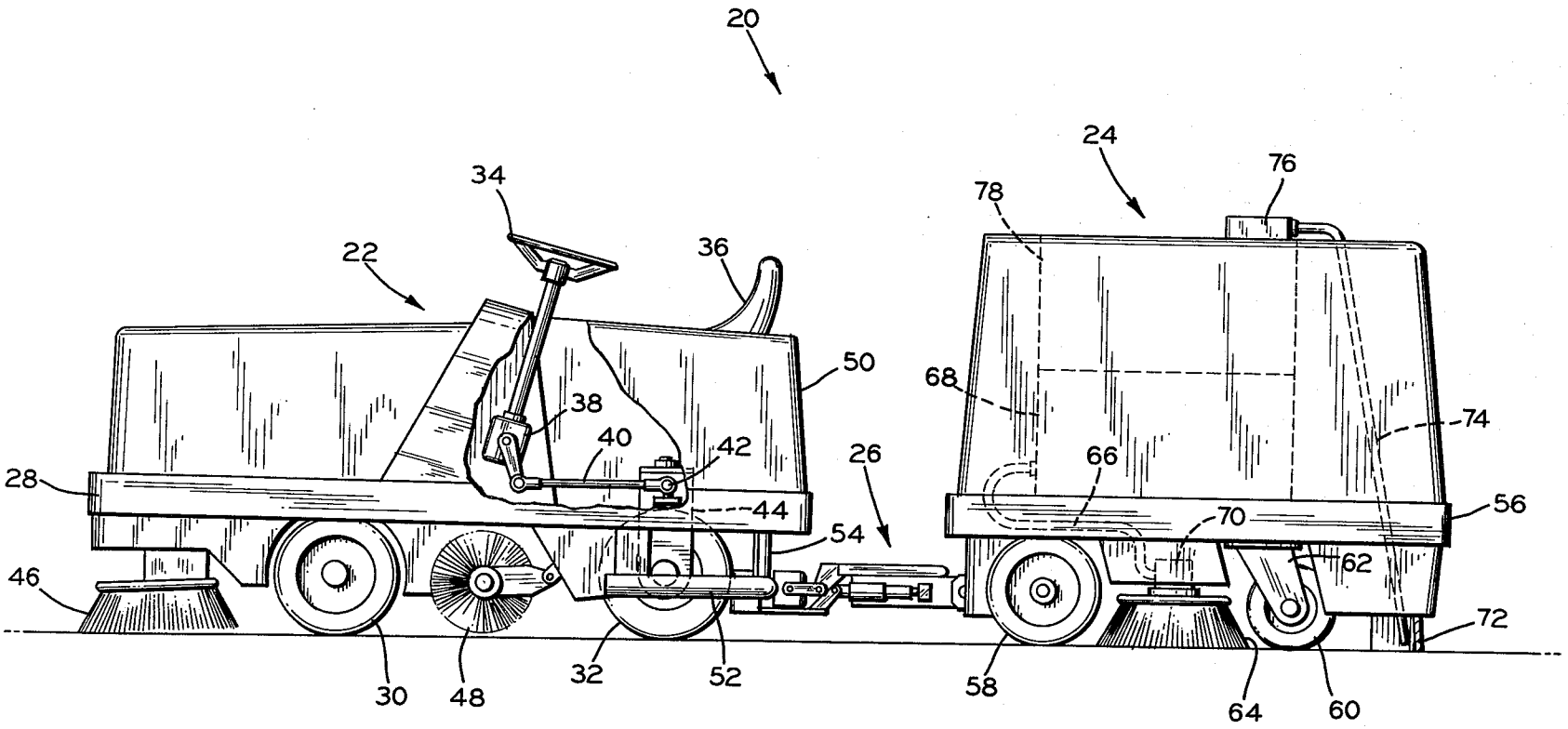
FIG. 1 is a somewhat schematic side view in elevation of a sweeper-scrubber in accordance with the invention.

Referring particularly to FIG. 1, a sweeper-scrubber in accordance with the invention is indicated at 20 and includes a sweeper 22 and a scrubbing unit 24 connected by a hitch 26.

The sweeper 22 can be of the type shown in Burgoon and Knowlton U.S. Pat. No. 4,173,052, issued on Nov. 6, 1979. It includes a main frame or body 28 with intermediate wheels 30 and a central rear wheel 32 which is steered by a steering wheel 34 located in front of an operator's seat 36. The wheel 32 is steered through a steering gear unit 38 connected to a link 40. The link 40 is connected to an arm 42 extending transversely from a pivotable yoke 44 which rotatably carries the wheel 32. A side broom 46 is located in front of the intermediate wheels 30 and a main drum brush 48 is located to the rear of these wheels. An engine and pump compartment 50 is located to one side of the operator's seat 36 for supplying hydraulic fluid under pressure to hydraulic motors (not shown) to drive the sweeper, the side broom 46, and the main drum brush 48.

Figure 2:
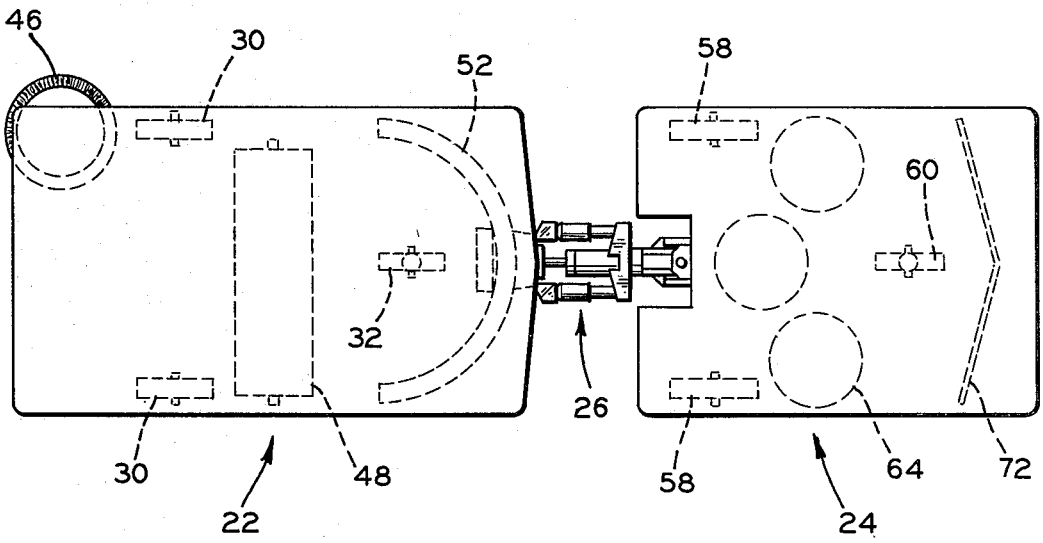
FIG. 2 is a schematic plan of the sweeper-scrubber of FIG. 1.
Figure 3:
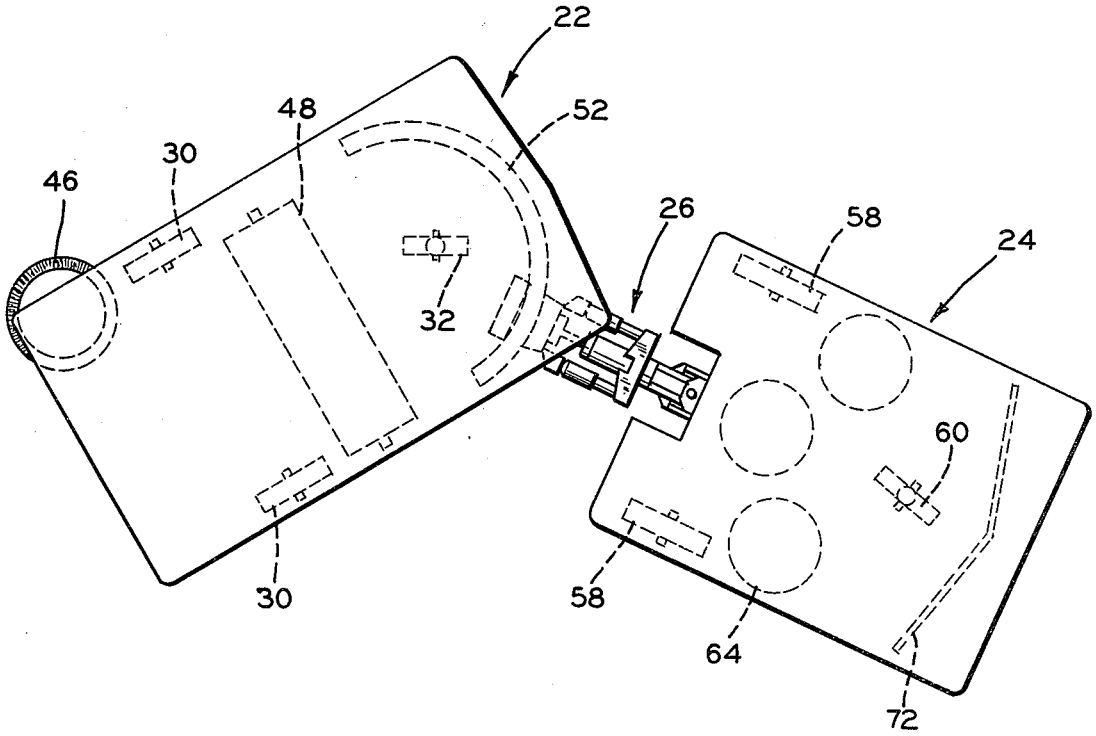
FIG. 3 is a view similar to FIG. 2 but with a sweeper and scrubbing unit in different positions.
Figure 4:
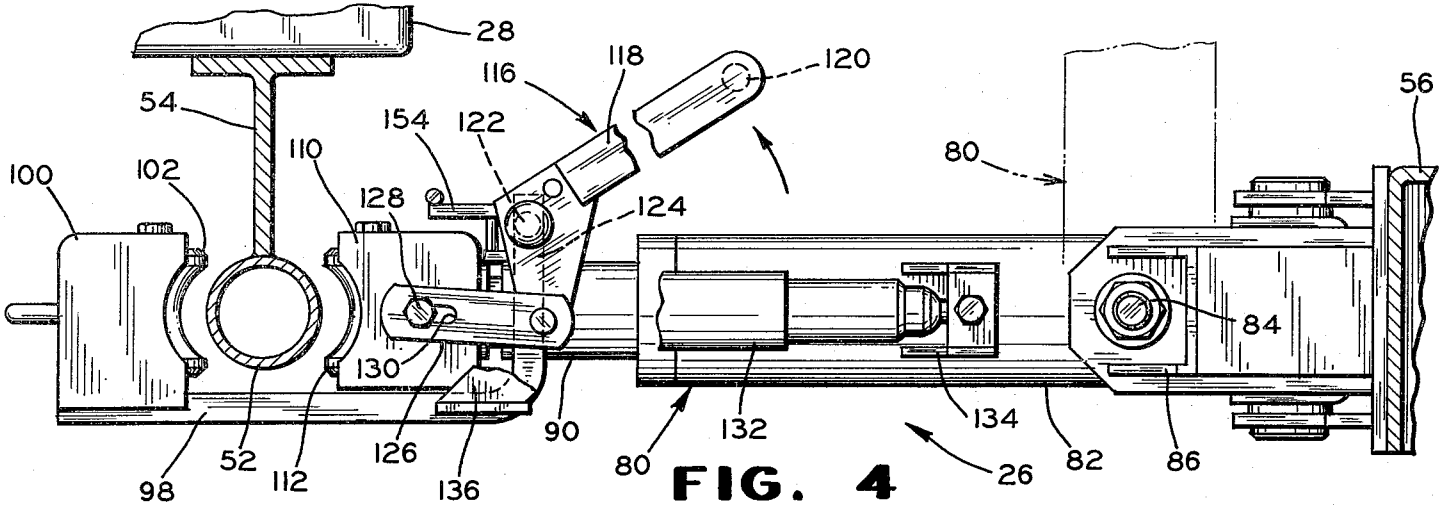
FIG. 4 is an enlarged, fragmentary side view, with parts broken away and with parts in cross section, of a hitch used with the sweeper and scrubbing unit.
Figure 5:
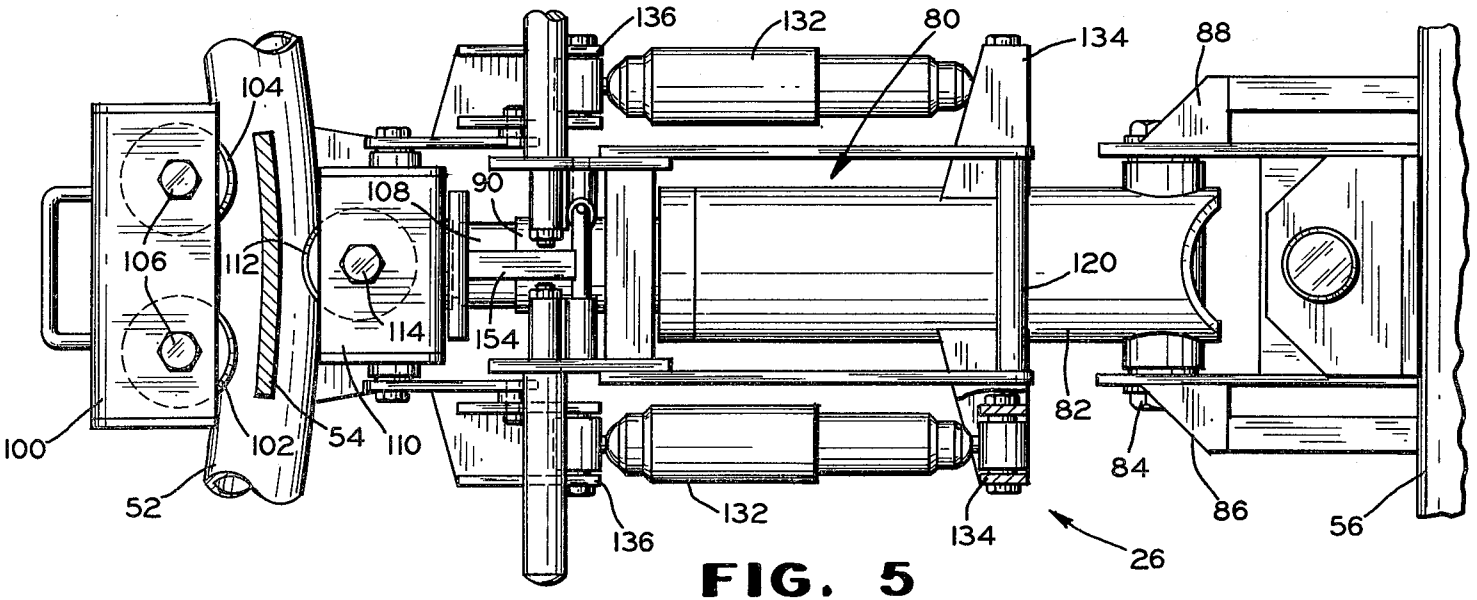
FIG. 5 is a plan view of the hitch of FIG. 4.
Figure 6:
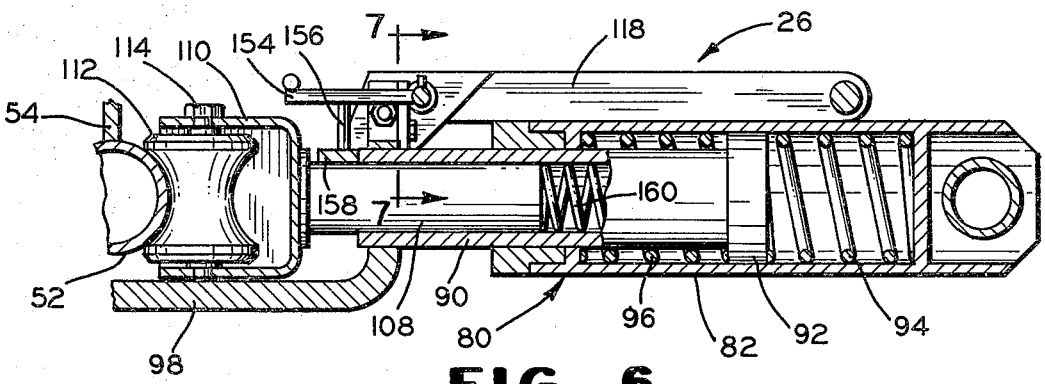
FIG. 6 is a smaller fragmentary view in longitudinal cross section of the hitch.

The sweeper 22 differs from that of the aforesaid patent in that it has an arcuate tow bar 52 located at the rear thereof which preferably is of tubular construction, as shown in FIG. 4, and is supported below the sweeper frame 28 by suitable supports 54. It extends through an arc of substantially 180 degrees, as shown in FIGS. 2 and 3. Preferably, the center of curvature of the arcuate tow bar 52 is in front of the pivot axis of the steerable rear wheel 32, as shown in FIGS. 2 and 3. This provides greater compactness for the sweeper.

The scrubbing unit 24 is substantially self-contained. It includes a body or frame 56 with front wheels 58 and a central, pivotable rear wheel 60 rotatably mounted in a caster yoke 62. The unit 24 also has three rotatable scrubbing brushes 64 to which cleaning fluid is supplied through lines 66 from a cleaning fluid supply tank 68. The scrubbing brushes 64 also are rotated through individual hydraulic motors 70. A pick-up squeegee 72 is located at the rear of the scrubbing unit 24. It collects water deposited through the brushes 64 with the water being picked up by a vacuum line 74 connected to a vacuum pump 76. This water is deposited in an upper recovery tank 78 located on top of the supply tank 68.

Referring more particularly to FIGS. 4–8, the towing hitch 26 will be discussed in more detail. The hitch 26 includes a tongue assembly 80 having a cylinder 82 which is pivotally connected to the frame 56 of the scrubbing unit 24 so that it can pivot to a vertical, out-of-the-way position when not in use, as shown in dotted lines in FIG. 4. This is accomplished by a bolt 84 extending through ears 86 and 88 which are affixed to the frame 56. A cylindrical tubular extension 90 extends forwardly out of the cylinder 82 and has a piston head 92 resiliently urged to a middle position in the cylinder 82 by coil springs 94 and 96. An L-shaped bracket 98 is affixed to the outer end of the cylindrical extension 90. The outer end of the bracket has a housing 100 thereon rotatably carrying two rollers 102 and 104 by axles 106. The rollers 102 and 104 are positioned to engage the inner surface of the arcuate tow bar 52.

A cylindrical bar 108 extends out of the tubular extension 90 and is affixed to a housing 110 rotatably carrying an additional roller 112 by means of an axle 114. The additional roller 112 is positioned to engage the outer surface of the arcuate tow bar 52 and is located between the rollers 102 and 104. The bar 108 is slidably mounted in the tubular extension 90 and can move relative thereto to move the additional roller 112 toward and away from the rollers 102 and 104 so as to engage the tow bar 52 with the hitch or release the hitch from it. The tow bar 52 is shown engaged in FIG. 5 and released in FIG. 4. This movement can be accomplished through an over-center linkage indicated at 116. The linkage 116 includes levers 118 connected by a handle 120 at the upper ends and pivotally supported by pins 122 to an upper portion 124 of the L-shaped bracket 98. Lifting handles 123 also extend outwardly from the pivot pins 122. Ends of the levers 118 on the side of the pivot pins 122 opposite the handle 120 are pivotally connected by links 126 to the housing 110 by suitable pins or bolts 128 extending through slots 130 in the links 126. With this arrangement, the rollers 102, 104, and 112 can always move together relative to the cylinder 82 when they engage the tow bar 52 and yet the additional roller 112 can be moved away from the rollers 102 and 104 to release the hitch 26 from the bar. The movement of the three rollers relative to the cylinder 82 and the frame 56 of the scrubbing unit 24 thus provides a yieldable connection between the sweeper 22 and the scrubbing unit 24. To dampen the action, shock absorbers 132 can be affixed to the cylinder 82 through ears 134 and connected to the L-shaped bracket 98 through ears 136. This connecting arrangement minimizes the chance for stuuctural damage to the hitch, the sweeper, or the scrubbing unit under the rugged use which the sweeper-scrubber 20 may be subjected in industrial cleaning operations.

Figure 7:
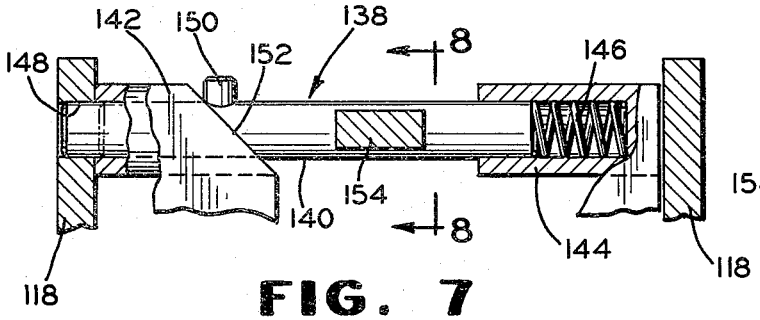
FIG. 7 is an enlarged, fragmentary view, with parts broken away and with parts in cross section, taken along the line of 7—7 of FIG. 6.
Figure 8:
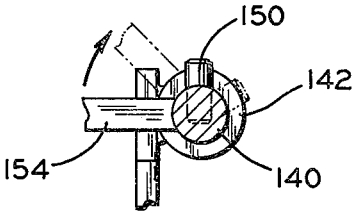
FIG. 8 is a view in transverse cross section taken along the line 8—8 of FIG. 7.

A safety latch 138 shown in FIGS. 7 and 8 is designed to prevent accidental release of the hitch 26 from the tow bar 52 by the raising of the handle 120. The latch 138 includes a bolt 140 slidably carried in a sleeve 142 and having an end extending into a housing 144 in which is a spring 146 urging the bolt 140 toward the left, as shown in FIG. 7. The sleeve 142 and the housing 144 are affixed to the upper end of the bracket 98. The bolt can thus extend into a hole 148 in one of the levers 118 to prevent raising of it until the bolt 140 is released. The bolt 140 has a transverse projection 150 which is urged against a slanted surface 152 on the sleeve 142. When the bolt 140 is turned by a handle 154 the cooperation of the projection 150 and the surface 152 retracts the bolt 140 from the hole 148 against the force of the spring 146 to enable the levers 118 to be raised and the roller 112 retracted so that the hitch can be released.

The handle 154 also has a shank 156 (FIG. 6) which extends downward and terminates in a stop plate 158. When the handle 154 is down and the bolt 140 is in the opening 148 during operation of the sweeper-scrubber 20, the stop plate 158 is positioned between the end of the tubular extension 90 and the housing 110. This prevents possible movement of the roller 112 away from the tow bar 52 during operation and accidental release of the hitch 26 from the bar 52. Even though the roller 112 is urged forwardly by a spring 160 acting on the end of the bar 108, the force of the spring 160 could be overcome during operation, when the scrubber-sweeper 20 is backed up, for example.

Figure 9:
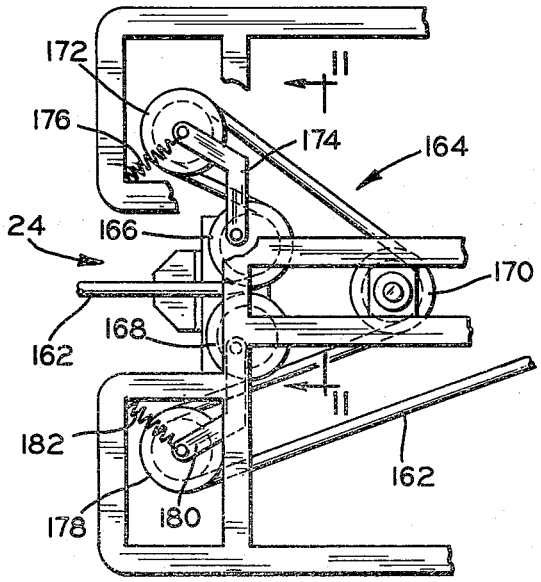
FIG. 9 is a somewhat schematic plan view of a take-up reel assembly of the scrubbing unit.
Figure 10:
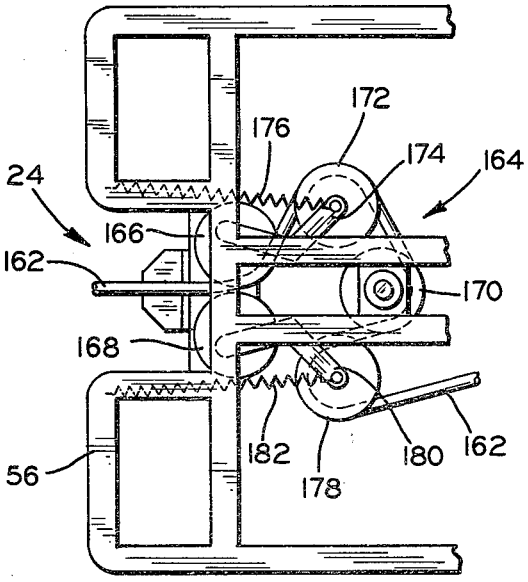
FIG. 10 is a view similar to FIG. 9 but with the reels of the assembly in different positions.
Figure 11:
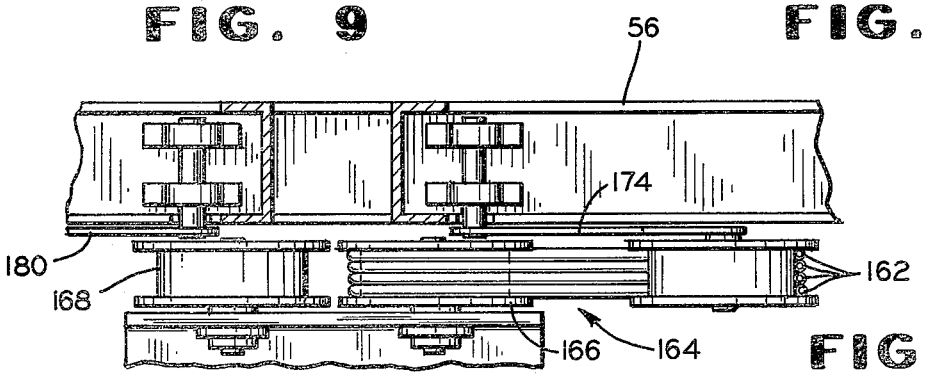
FIG. 11 is an enlarged view in section taken along the line 11—11 of FIG. 9.

Referring now to FIGS. 9–11, the scrubbing unit 24 is self-contained except for receiving fluid under pressure and electricity through a plurality of flexible lines or hoses 162. In this instance, four of the lines are employed, one having conductors for electricity, one for supplying fluid under pressure to the scrubbing unit, one for returning fluid from the scrubbing unit to the sweeper, and a case drain line for returning fluid to the sweeper from the housing of the hydraulic motors 70 operating the brushes 64. The electrical power is needed for the vacuum pump 76.

The lines 162 tend to become slack under normal operations as the sweeper 22 turns relative to the scrubbing unit 24. To take up this slack and prevent drag of the lines on the surface being cleaned, a take-up reel assembly indicated at 164 is carried by the scrubbing unit. The reel assembly 164 includes two rotatable entry reels 166 and 168 rotatably carried by the frame 56 in fixed positions. The lines 162 enter between these reels 166 and 168. A third rotatable reel 170 is rotatably carried in a fixed position by the frame 56 spaced to the rear of the reels 166 and 168. A first yieldable reel 172 is located between the reels 166 and 170 and is rotatably mounted on a pivot arm 174 which is urged outwardly by a spring 176. Similarly, a second yieldable reel 178 is located between the fixed reels 170 and 168. This reel is rotatably mounted on a pivot arm 180 and is urged outwardly by a spring 182. The assembly 164 maintains substantially constant tension on the lines 162 and slack is taken up as the reels 172 and 178 move outwardly from the positions of FIG. 10 to the positions of FIG. 9.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. In combination, a sweeper having a rotatable sweeping brush, and connecting means at a rear portion thereof, a scrubbing unit having a rotatable scrubbing brush, a tank for supplying clean water to a surface to be cleaned, a recovery tank, means for returning water from the surface to the recovery tank, and a hitch extending forwardly of the scrubbing unit and connected to said connecting means to enable said scrubbing unit and said sweeper to move in horizontal angular relationship relative to one another.

2. The combination according to claim 1 wherein said sweeper has a single rear wheel, and means for steering said rear wheel.

3. The combination according to claim 2 wherein said scrubbing unit has a single rear wheel which is pivotally mounted on said scrubbing unit.

4. The combination according to claim 1 wherein said scrubbing unit has a single rear wheel which is pivotally mounted on said scrubbing unit.

5. The combination according to claim 1 wherein said connecting means is an arcuate member with the concave side facing forwardly and located in a generally horizontal plane.

6. The combination according to claim 5 wherein said hitch is movably connected to said arcuate member and movable along said member.

7. In combination, a sweeper having an arcuate member located at a rear portion thereof, said arcuate member having a concave side facing forwardly and a convex side facing rearwardly and located in a generally horizontal plane, and a scrubbing unit having a hitch extending forwardly and having at least one roller engagable with the concave side of said arcuate member.

8. The combination according to claim 7 wherein said sweeper has a steerable rear wheel located behind the center of curvature of said arcuate member.

9. The combination according to claim 8 wherein said scrubbing unit has a single rear pivotable wheel.

10. The combination according to claim 7 wherein said scrubbing unit has a single rear pivotable wheel.

11. The combination according to claim 7 wherein said hitch has at least one additional roller engagable with the convex side of said arcuate member.

12. The combination according to claim 7 wherein said hitch has a second roller engagable with the concave side of said arcuate member and said hitch has an additional roller engagable with the convex side of said arcuate member between said one roller and said second roller.

13. The combination according to claim 11 wherein said hitch has means for moving said additional roller toward and away from said one roller to engage said hitch with said arcuate member and to release said hitch from said arcuate member.

14. The combination according to claim 13 characterized by said hitch having resilient means for yieldably supporting said one roller and said additional roller relative to said scrubbing unit.

15. The combination according to claim 14 wherein said hitch has damping means for damping movement of said one roller and said additional roller relative to said scrubbing unit.

16. In combination, a sweeper having connecting means at a rear portion thereof, a scrubbing unit having a rotatable scrubbing brush, a tank for supplying clean water to a surface to be cleaned, a recovery tank, means for returning water from the surface to the recovery tank, a hitch extending forwardly of the scrubbing unit and connected to said connecting means to enable said scrubbing unit and said sweeper to move in horizontal angular relationship relative to one another, a hydraulically-operated motor for rotating said scrubbing brush, means including flexible line means for supplying hydraulic fluid under pressure to said motor from said sweeper, and resilient take-up means mounted on said scrubbing unit for taking up slack in said line means.

17. The combination according to claim 16 wherein said resilient take-up means comprises a rotatable reel engaging said flexible line means and a resiliently-mounted additional reel engaging said line means and movable toward and away from said rotatable reel.

18. The combination according to claim 16 wherein said connecting means is an arcuate member with the concave side facing forwardly and located in a generally horizontal plane, and said hitch is movably connected to said arcuate member and movable along at least a substantial portion of the length thereof.

19. The combination according to claim 18 wherein said hitch has at least one roller engagable with the concave side of said arcuate member.

20. The combination according to claim 19 wherein said hitch has an additional roller engagable with the convex side of said arcuate member, and means for moving said additional roller toward and away from said one roller.

* * * * *